US006536083B1

(12) United States Patent
Dozzini

(10) Patent No.: US 6,536,083 B1
(45) Date of Patent: Mar. 25, 2003

(54) CLOSING CLIP FOR TETRAPAK® AND SIMILAR PACKAGES USED FOR FOOD DISTRIBUTION

(76) Inventor: Andrea Dozzini, 06010 Monte Santa Mariatiberina, Perugia (IT)

( * ) Notice: Subject to any disclaimer, the term of this patent is extended or adjusted under 35 U.S.C. 154(b) by 0 days.

(21) Appl. No.: 09/856,953

(22) PCT Filed: Nov. 11, 1999

(86) PCT No.: PCT/IT99/00363

§ 371 (c)(1),
(2), (4) Date: May 29, 2001

(87) PCT Pub. No.: WO00/32479

PCT Pub. Date: Jun. 8, 2000

(30) Foreign Application Priority Data

Nov. 27, 1998 (IT) ..... RM980283 U

(51) Int. Cl.[7] ..... B65D 45/16; B65D 77/10

(52) U.S. Cl. ..... 24/30.5 R; 24/30.5 T; 24/30.5 S; 24/30.5 W; 229/125.39

(58) Field of Search ..... 24/30.5 R, 30.5 T, 24/30.5 S, 30.5 W; 229/125.12, 125.39, 125.42

(56) References Cited

U.S. PATENT DOCUMENTS

| | | | | | |
|---|---|---|---|---|---|
| 3,217,967 | A | * | 11/1965 | Jackson | 24/30.5 R |
| 3,334,805 | A | * | 8/1967 | Halbach | 229/125.39 |
| 3,693,864 | A | * | 9/1972 | Wilkins | 229/125.39 |
| 4,619,398 | A | * | 10/1986 | Laramie | 229/125.39 |
| 4,736,538 | A | * | 4/1988 | Pierce et al. | 40/158 B |
| 4,979,668 | A | * | 12/1990 | Allen et al. | 229/125.39 |
| 5,349,724 | A | * | 9/1994 | Barcina et al. | 24/30.5 R |
| 5,462,222 | A | * | 10/1995 | Boeck II | 229/125.39 |
| 5,503,327 | A | * | 4/1996 | Barnes | 229/160.2 |
| 5,507,431 | A | * | 4/1996 | Bertone | 229/125.39 |
| 5,836,055 | A | * | 11/1998 | Cooper | 24/339 |
| 6,311,700 | B1 | * | 11/2001 | Yeh | 132/279 |

* cited by examiner

*Primary Examiner*—Victor Sakran
(74) *Attorney, Agent, or Firm*—Browdy and Neimark, P.L.L.C.

(57) ABSTRACT

The object of the present invention is a closing clip for Tetrapak® and similar packages used for the distribution of food items, with a pouring spout obtained by tearing a pre-established section near the two welded end tabs of a package. It is composed of a plastic body with a slit sized to encompass the terminal tabs. The slit is delimited by rough parallel surfaces that diverge near at least one corner of the body in order to insert the spout and, more preferably, along all the open sides of the slit.

4 Claims, 2 Drawing Sheets

CLOSING CLIP FOR TETRAPAK® AND SIMILAR PACKAGES USED FOR FOOD DISTRIBUTION

The present application is the national stage under 35 U.S.C. 371 of international application PCT/IT99/00363, filed Nov. 11, 1999 which designated the United States, and which international application was published under PCT Article 21 (2) in the English language.

TECHNICAL FIELD

This invention involves a closing clip for Tetrapak® and similar packages used for food distribution; particularly liquids.

BACKGROUND ART

These packages are composed of a tube made from a web of waterproofed paper that is folded and sealed at the ends to obtain the corresponding shape. In some types of these packages, such as the tetrahedral-shaped one known as "Tetra Classic", the rectangular parallelepiped-shaped one known as "Tetra Brik" and the square parallelepiped-shaped one known as "Tetra Rex", a pouring spout is created by tearing a pre-established portion of the two welded end tabs.

This spout is convenient far pouring the contents of the package, but it cannot be closed again. As a result, the liquid food items that are not consumed when the package is opened can turn sour or deteriorate during subsequent refrigeration due to external agents, such as bacteria, that may be present in the air circulating inside the refrigerator. In addition, since the package stays open, its contents can spill if the package is not kept and handled in an essentially vertical position. In general, the contents can spill because these packages are usually kept on the shelves in the door of the refrigerator and they are subject to jolts when the door is opened. However, when the packages are placed on the grids or shelves inside the refrigerator, part of their contents can also be spilled when the packages are moved to get something else from the refrigerator.

The present invention thus focuses on eliminating the above-mentioned problems.

DISCLOSURE OF INVENTION

In particular; one of the purposes of this invention is to resolve the problem of leakage of the liquids contained in the types of packages listed above when they are being used.

Another objective of this invention is to extend the conservation time of the package contents by preventing contamination by external agents that could alter the quality of the contents.

Yet another objective is to guarantee proper hygiene of the spout so that it does not come into contact with external agents such as insects, bacteria and other agents.

The invention, as it is characterized by the claims listed below, solves the problem of supplying a closing clip for Tetrapak® and similar packages used for food distribution, via a pouring spout obtained by tearing a pre-established portion near the two welded end tabs on a package composed of a plastic body with a slit. From a general viewpoint, this closing clip is characterized by the fact that the slit is delimited by two portions that differ thickness so that portion has an indentation forming a depression in the slit; said slit encompassing said end tabs.

BRIEF DESCRIPTION OF DRAWINGS

The additional characteristics and advantages of this invention can be seen better from the detailed description that follows. The preferred examples illustrated in the attached drawings are given strictly as an indication, but without any limitations thereof.

BEST MODE FOR CARRYING OUT THE INVENTION

In accordance with the present invention, the closing clip for Tetrapak® and similar packages is composed, in an initial example, of a body (1) made of a suitable plastic material, such as PTFE, shaped like a triangular prism and, more specifically, like an isosceles triangle.

Figure 1:
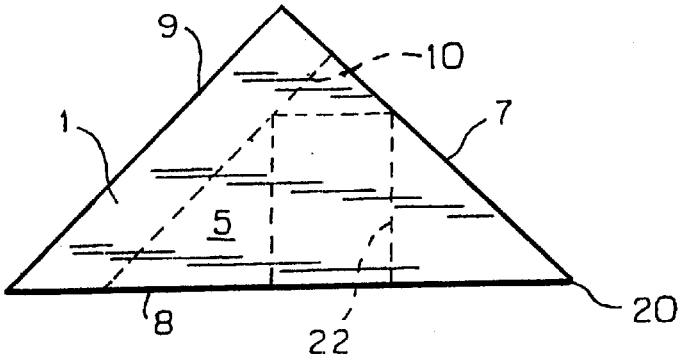
FIG. 1 gives a top plan view illustrating the closing clip according to the present invention.
Figure 2:
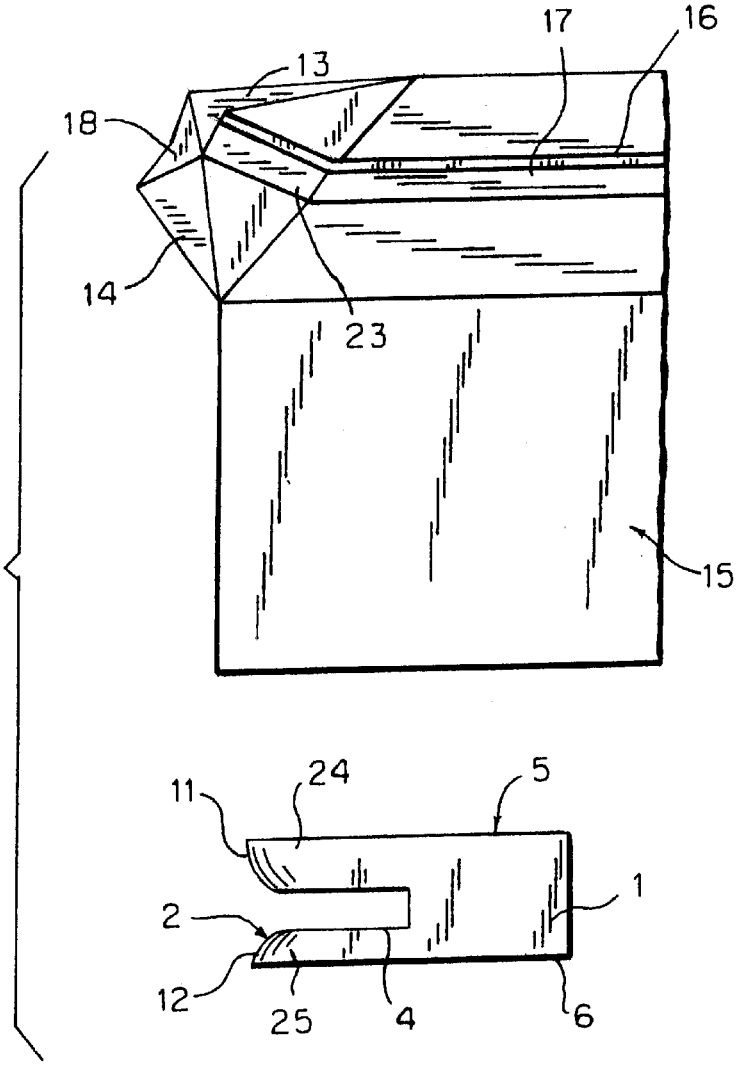
FIG. 2 gives a lateral view of the closing clip shown is FIG. 1 with an open "Tetra Brik" type of package.

The body (1) has a slit (2) delimited by the inner surfaces FIG. 2 (3,4) of the body (1), which should preferably be parallel to each other. In this example, the inner surfaces (3,4) are parallel at the external opposite bases (5,6) of the body (1). The slit (2) communicates with the outside on two open lateral faces FIG. 1 (7,8) of the body FIG. 1 (1), meaning the faces corresponding to one of the equal sides and to the base of the triangle FIG. 1. Instead, on the face FIG. 1 (9) corresponding to the other equal side of the isosceles triangle, it is closed by a wall FIGS. 1–2 (10). The wall FIG. 1 (10) is shown parallel to the face FIG. 1 (9) of the body FIG. 1 (1) but as an alternative, it can lie on a plane that intersects the plane of the face FIG. (9).

In particular, the angle of the triangle between the sides of the faces FIG: 1 (7,9) should preferably be a ninety-degree angle. The inner surfaces FIG. 2 (3,4) of the body FIG. 2 (1) that delimit the slit FIG. 2 (2) have a respective bevel FIG. 2 (11,12) so that they will diverge near the corner FIGS. 1–2 (20) of the body FIG. 1 (1) that the faces FIG. 1 (7,8) have in common. In other words, the outline of the corner is the vertex opposite the face FIG. 1 (9). Preferably, the surfaces FIG. 2 (3,4) diverge not only in the corner FIG. 2 (20) but also on the faces FIG. 1 (7,8), meaning that these faces are beveled towards the inside of the slit FIG. 3 (2) to facilitate insertion of the clip in the tabs of a package.

As shown in FIG. 2, the slit (2) is sized in both width and thickness to allow the body FIG. 2 (1) to encompass in an essentially complete manner the end tabs (13,14) of an open package, such as the Tetra Brik type, shown in dotted lines and marked generally as FIG. 2 (15). When opening the package, the end tabs FIG. 2 (13,14), which are welded along their respective coinciding edges FIG. 2 (16,17), are usually torn when opening the package at the prepared edge in order to form a spout FIG. 2 (18). Ideally, the surfaces FIG. 2 (3,4) delimiting the slit FIG. 2 (2) will be suitably rough.

Figure 3:
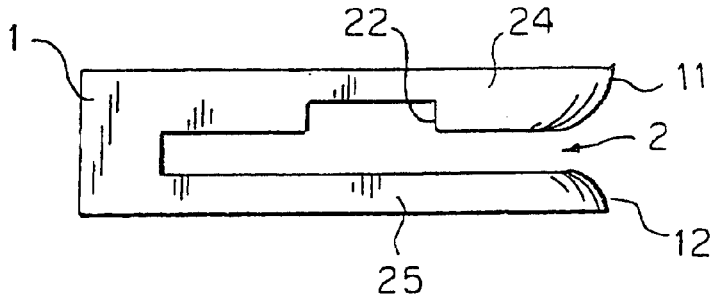
FIG. 3 gives a lateral view of the closing clip shown in FIG. 1.

As shown in FIG. 3 the clip according to the present invention has two portions (24, 25) of the body that differ in thickness so that portion (24) has an indentation (22) to create a depression in the slit that is useful for taking in and holding the portion of the welded tabs (23) of package (15).

During use, the closing clip described above is set close to the package (15) in a horizontal direction, meaning laterally with respect to its tab (13) with the bevels (11,12), and it is made to advance on it so that the surfaces (3,4) of the body (1) will consecutively flatten the tab (13), the edges (16, 17) and, lastly, the tab (14). The spout (18) is thus hermetically closed, since it is gripped between the two halves of the body (1) and as a result, the liquid food item contained in the package cannot leak from it. For this closing operation, the shape exemplified in FIG. 2 is especially convenient: here, the corresponding edges (16, 17) of the end tabs (13, 14) are housed in the indentation (22).

Advantageously, the closing clip according to this invention is conveniently inserted vertically to achieve hermetic closing of the spout (18).

The rigidity of the material used for the body (1) is suitable for flexibly applying gripping pressure on the edges (13,14) of the package (15). The roughness of the inner surfaces (3,4) of the body (1) helps hold the clip to the spout (18) through friction.

Figure 4:
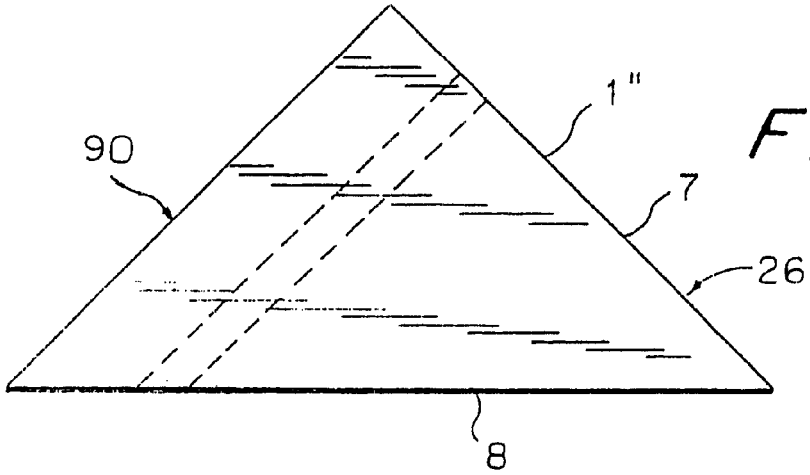
FIGS. 4 and 5 offer a plan and side view illustrating a second example of the closing clip according to the present invention.
Figure 5:
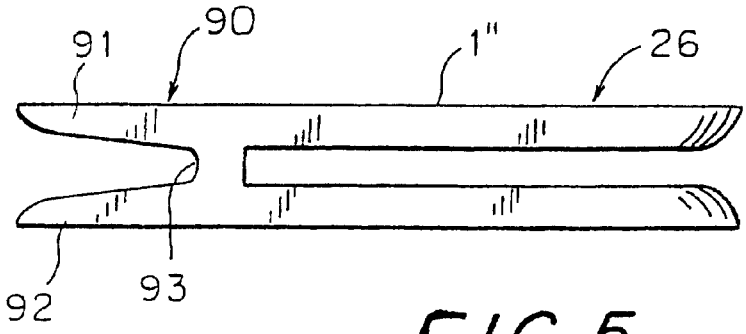

In order to enhance the aforesaid gripping effect, the closing clip according to the present invention can have the shape illustrated in FIGS. 4 and 5. In this second example, marked as number 26, one face (90) of the triangular prism of the body (1") extends along two forked branches (91, 92), representing the power of a pincer lever whose fulcrum is in (93). In this example as well, the indentation described above (22) could be made in order to enable horizontal insertion of the clip.

It is important to understand that the body (1) can have a shape other than the triangular prismatic one that is illustrated and described herein. For example, the body (1) can have an ergonomic shape, which is not shown here, so it can be gripped comfortably in order to be applied and removed from the package. Otherwise, the body (1) can be made in a different shape such as a half moon, a square, etc. or any fancy shape.

Obviously, in practice it is possible to make modifications and/or improvements that, in any event, are covered by the following claims.

What is claimed is:

1. The closing clip for Tetrapak® and similar packages used for the distribution of food items, with a pouring spout (18) obtained by tearing a pre-established section near the two welded end tabs (13,14) of a package (15), said clip being composed of a plastic body (1, 1") with a slit (2), wherein in said body said slit is delimited by two portions (24, 25) that differ in thickness and one of the portions (24) has an indentation (22) forming a depression in the slit (2), and further wherein said slit (2) is formed to encompass said end tabs (13,14), said body (1) has the form of a triangular prism in a plane parallel to said slit, and said slit (2) is delimited by rough parallel surfaces (3,4) that diverge near at least one corner (20) of said body (1) in order to insert the spout (18) and also diverge on the open faces (7,8) of said body (1).

2. The clip as claimed in claim 1, characterized by the fact that said rough parallel surfaces (3,4) delimiting the slit (2) are parallel to the external bases of the body (1).

3. The clip as claimed in claim 1, characterized by the fact that said triangular prism has the shape of an isosceles triangle, in which the outline of said corner (20) is the vertex opposite the one of the equal sides of said isosceles triangle.

4. The clip as claimed in claim 1, characterized by the fact that said body (1") is extended along two forked branches FIG. 9 (91,92) of a pincer lever.

* * * * *